US006041204A

United States Patent [19]

Haneda et al.

[11] Patent Number: 6,041,204

[45] Date of Patent: Mar. 21, 2000

[54] COLOR IMAGE FORMING APPARATUS WITH AN ORGANIC PHOTOCONDUCTOR

[75] Inventors: Satoshi Haneda; Hiroyuki Tokimatsu; Masahiro Onodera; Shuta Hamada, all of Hachioji, Japan

[73] Assignee: Konica Corporation, Tokyo, Japan

[21] Appl. No.: 09/223,701

[22] Filed: Dec. 30, 1998

[30] Foreign Application Priority Data

Jan. 7, 1998 [JP] Japan ..... 10-001494
Jan. 21, 1998 [JP] Japan ..... 10-009603

[51] Int. Cl.[7] ..... G03G 15/00

[52] U.S. Cl. ..... 399/159; 399/177; 399/128; 399/296; 399/178; 347/118

[58] Field of Search ..... 399/127, 128, 399/129, 296, 177, 178, 159, 223, 231; 347/118, 130, 140

[56] References Cited

U.S. PATENT DOCUMENTS 4,529,292 7/1985 Ohseto ..... 399/128
4,623,243 11/1986 Iijima et al. ..... 399/128
4,669,855 6/1987 Iwahashi ..... 399/128
4,945,389 7/1990 Usui et al. ..... 399/71
5,303,009 4/1994 Nishizawa ..... 399/71
5,541,722 7/1996 Ikeda et al. ..... 399/178
5,697,025 12/1997 Tokimatsu et al. ..... 399/159
5,701,560 12/1997 Tsujita et al. ..... 399/159

*Primary Examiner*—Robert Beatty
*Attorney, Agent, or Firm*—Frishauf, Holtz, Goodman, Langer & Chick, P.C.

[57] ABSTRACT

In a color image forming apparatus provided with a photoreceptor having a rotatable peripheral surface; plural sets of a charging device, an imagewise exposure device, and a developing device, each set of the plural sets is provided separately from other sets around the peripheral surface of the photoreceptor so that plural color component images are formed one after another by the plural sets and are superimposed so as to form a color image on the peripheral surface during a single rotation of the peripheral surface. The developing device has a casing and the imagewise exposure device and the developing device of each set are arranged such that a portion on the peripheral surface locating at an imagewise exposing position moves into the casing of the developing device before the electric potential V1 of the portion is lowered to the half of V1 (V1/2). A pre-transfer exposing device/transfer device and pre-cleaning exposing device/cleaning device all operate such that the potential on the photoreceptor moves into the casings of the transfer device or cleaning device before the potential is lowered to half its value.

9 Claims, 9 Drawing Sheets

COLOR IMAGE FORMING APPARATUS WITH AN ORGANIC PHOTOCONDUCTOR

BACKGROUND OF THE INVENTION

This invention relates to an image forming apparatus such as a copying machine, a printer, and a fax, and in particular, a color image forming apparatus of electrophotographic type wherein a plurality of sets of charging means, image exposure means, and developing means are arranged to form a color image within one rotation of an image forming member by superposing toner images.

Heretofore, for the method to form a multi-color image, the following have been known: a color image forming apparatus wherein a number of image forming members, charging means, developing means and so forth, said number being the same as the number of colors required to form a color image, are provided to make the color image by superposing monochromatic toner images formed on each of the image forming members on a transfer material; a color image forming apparatus wherein charging, image exposure, and development are repeated for the respective colors by rotating an image forming member a plurality of times to form the color image; a color image forming apparatus wherein charging, image exposure, and development for the respective colors are sequentially done within one rotation of an image forming member to form a color image; and so forth.

However, among the above-mentioned image forming apparatus, the color image forming apparatus wherein a number of image forming members, charging means, developing means and so forth, said number being the same as the number of colors required to form a color image, are provided to make the color image by superposing monochromatic toner images formed on each of the image forming members on a transfer material has a defect that it requires a plurality of image forming members and means for transporting a transfer material to make the apparatus large-sized; and on the other hand, the color image forming apparatus wherein charging, image exposure, and development are repeated for the respective colors by rotating an image forming member a plurality of times to form the color image is made small-sized with respect to its volume, but it has the limitation that the size of the image to be formed is limited to the same or smaller size than the surface area of the image forming member.

In that regard, the color image forming apparatus wherein charging, image exposure, and development for the respective colors are sequentially done within one rotation of an image forming member to form a color image has advantages such as that it has no limitation in the size of the image and that it enables a high-speed image forming. Further, the one wherein a transparent substrate is used for the image forming member and the image forming means are disposed inside the image forming member to make the apparatus small-sized is proposed in the Japanese laid open patent H5-307307, for example.

Further, for the photosensitive layer of the image forming member to be used in a color image forming apparatus, an OPC (organic photoconductor) is generally used owing to its low cost and stability.

However, in the image forming apparatus according to the above-mentioned proposal, in the case of an OPC used for the photosensitive layer, a comparatively long time (0.05–0.2 sec) is required for the electric potential to be lowered to a low level owing to its low mobility of the electric charge carrier. Moreover, it has a large dependence of the electric potential on temperature. For this reason, different to the inorganic photosensitive materials such as selenium, it is required a time period for the electric potential to be lowered from the imagewise exposure by the imagewise exposure means to the development by the developing means. That is, since it is necessary to set the developing position at the position where the electric potential is sufficiently lowered from the imagewise exposure, the apparatus inevitably becomes large in its size.

On the other hand, when the electric potential of the charged image forming member is lowered to a level below about a half (charge elimination by light) owing to the imagewise, toner scattering may take place from the toner image previously formed on the image forming member, resulting in the problem that the inside of the apparatus is soiled by the toner scattering.

It is the first object of this invention to provide an image forming apparatus wherein the above-mentioned points of problem are improved, that is, the size is made small, and at the same time, the soil on the inside of the apparatus and the soil on the charging means by the toner scattering from the toner image owing to the lowering of the electric potential is prevented; the soil on the imagewise exposure means in the case the imagewise exposure means is provided on the outside of the image forming member is also prevented.

Further, in the color image forming apparatus according to the above-mentioned proposal, it is employed a pre-transfer exposure means for eliminating the charge on the image forming member by exposing it to a uniform light, but if an OPC is used for the image forming member, a comparatively long time (0.05–0.2 sec) is required until the electric potential is lowered owing to the low mobility of the charge carrier. Moreover, the variation of the electric potential with the variation of temperature is also large. For this reason, different to the inorganic photosensitive materials such as selenium, it is required a time period for the electric potential to be lowered within the path from the pre-transfer charging means to the transfer position by the transfer means. That is, it is necessary to dispose the transfer means at a position with an enough distance from the pre-transfer exposure means for the electric potential to be lowered sufficiently, which produces the problem that the apparatus is made large-sized.

On the other hand, when the electric potential of the charged image forming member is lowered to the same as or lower than about a half level (charge elimination by light) by the uniform exposure in the pre-transfer exposure means, the electrically attaching force of the color toner image on the image forming member to the image forming member is weakened to generate the toner scattering, which causes the problem to occur that the inside of the machine is smudged by the toner particles scattered. In addition, in the case of the apparatus wherein the image exposure means are disposed outside the image forming member, the problem that the image exposure means are smudged by the toner particles scattered is also produced.

It is the second object of this invention to provide a color image forming apparatus wherein the above-mentioned points of problem are improved, that is, the apparatus is made small-sized, and at the same time, it is prevented the smudge inside the machine brought about by the toner particle scattering from the color toner image on the image forming member, of which the attaching force is weakened by the lowering of the electric potential after the uniform exposure in the pre-transfer exposure means (charge elimination by light), and further, it is also prevented the smudge of the image exposure means brought about by the toner particle scattering in the case where the image exposure means are provided outside the image forming member.

Further, in the color image forming apparatus according to the aforesaid proposal, a pre-cleaning exposure means for eliminating the residual charge on the image forming member by exposing the image forming member to the uniform exposure light in order to make it easy the cleaning of the residual toner particles after transfer, but if an OPC is used for the image forming member, a comparatively long time (0.05–0.2 sec) is required until the electric potential is lowered owing to the low mobility of the charge carrier. Moreover, the variation of the electric potential with the variation of temperature is also large. For this reason, different to the inorganic photosensitive materials such as selenium, it is required a time period for the electric potential to be lowered within the path from the position of the uniform exposure by the pre-cleaning exposure means to the cleaning position by the cleaning blade engaging with the image forming member of the cleaning means for cleaning the residual toner particles after transfer on the image forming member. That is, it is necessary to arrange the engaging position of the cleaning blade with an enough distance from the position of the uniform exposure by the pre-cleaning exposure means for the electric potential to be lowered sufficiently, which produces the problem that the apparatus is made large-sized.

On the other hand, when the electric potential of the charged image forming member is lowered to the same as or lower than about a half level (charge elimination by light) by the uniform exposure in the pre-cleaning exposure means, the electrically attaching force of the residual toner particles after transfer on the image forming member to the image forming member is weakened to generate the toner scattering, which causes it to occur the problem that the inside of the machine is smudged by the toner particles scattered. In addition, in the case of the apparatus wherein the image exposure means are disposed outside the image forming member, the problem that the image exposure means are smudged by the toner particles scattered is also produced.

It is the third object of this invention to provide a color image forming apparatus wherein the above-mentioned points of problem are improved, that is, the apparatus is made small-sized, and at the same time, it is prevented the smudge inside the machine brought about by the toner particle scattering from the residual toner particles after transfer on the image forming member, of which the attaching force is weakened by the lowering of the electric potential after the uniform exposure in the pre-cleaning exposure means (charge elimination by light), and further, it is also prevented the smudge of the image exposure means brought about by the toner particle scattering in the case where the image exposure means are provided outside the image forming member.

SUMMARY OF THE INVENTION

The above-mentioned first object is accomplished by a color image forming apparatus having a plurality of charging means, image exposure means, and developing means arranged around the peripheral surface of an image forming member to form a color toner image composed of a plurality of toner images superposed on the peripheral surface of said image forming member by repeating charging, exposure, and development during one rotation of said image forming member, wherein an organic photosensitive material is used in said image forming member, and it is arranged for the process from the image-exposure position of said exposure means to said developing means, that the image-exposed area on said image forming member moves into said developing means before the electric potential V1 of the image-exposed area on said image forming member at the position of said image exposure is lowered to (V1)/2.

Further, the above-mentioned second object is accomplished by a color image forming apparatus having a plurality of charging means, image exposure means, and developing means arranged around the peripheral surface of an image forming member to form a color toner image composed of a plurality of toner images superposed on the peripheral surface of said image forming member by repeating charging, exposure, and development during one rotation of said image forming member, and forming a color image by transferring said color toner image onto a recording material by a transfer means and fixing the color toner image on said recording material, wherein an organic photosensitive material is used in said image forming member, a pre-transfer exposure means for making said image forming member exposed to a uniform light is provided, and it is arranged for the process from the uniform exposure position of said pre-transfer exposure means to said transfer means, that the exposed area on said image forming member moves into said transfer means before the electric potential V2 of the exposed area on said image forming member at the position of said uniform exposure is lowered to (V2)/2.

Further, the above-mentioned third object is accomplished by a color image forming apparatus having a plurality of charging means, image exposure means, and developing means arranged around the peripheral surface of an image forming member to form a color toner image composed of a plurality of toner images superposed on the peripheral surface of said image forming member by repeating charging, exposure, and development during one rotation of said image forming member, and forming a color image by transferring said color toner image onto a recording material by a transfer means and fixing the color toner image on said recording material, while cleaning the residual toner particles after transfer on said image forming member by a cleaning blade provided in a leaning means, wherein an organic photosensitive material is used in said image forming member, a pre-cleaning exposure means for making said image forming member exposed to a uniform light is provided, and it is specified, with respect to the process from the uniform exposure position of said pre-cleaning exposure means to said cleaning means, that the exposed area on said image forming member moves into said cleaning means before the electric potential V3 of the exposed area on said image forming member at the position of said uniform exposure is decreased to (V3)/2.

DETAILED DESCRIPTION OF THE PREFERRED EMBODIMENT

In the following, an embodiment of this invention will be explained. In addition, the description in this application does not limit the technical scope of the claims and the meaning of the terms used in the claims. Further, the decisive explanation in the following embodiment of this invention indicates the best mode and does not confine the meaning of the terms used and the technical scope. Moreover, the image exposure means are disposed inside the image forming member in the following explanations, however, the case where the exposure means are disposed outside the image forming member should also be included in this invention.

Figure 1:
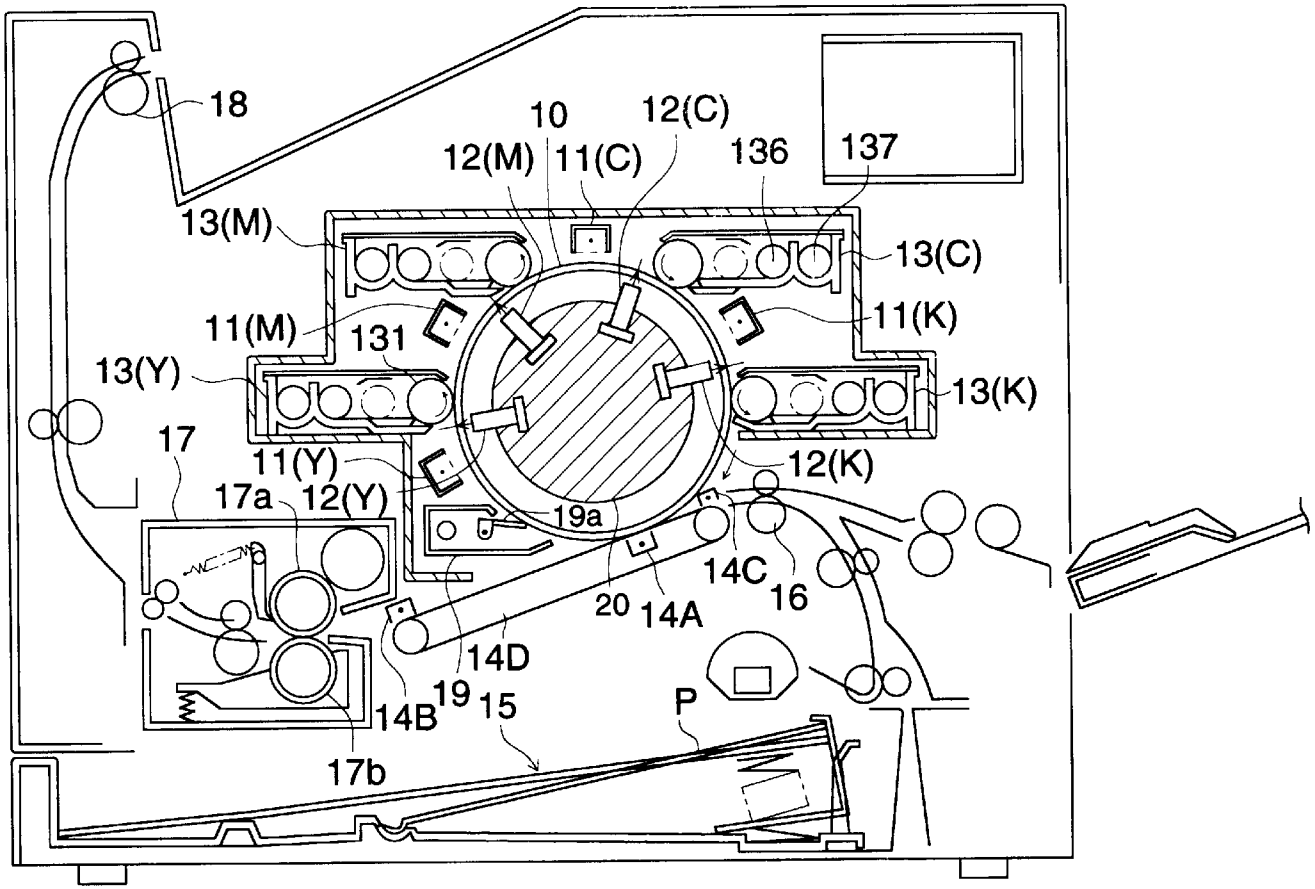
FIG. 1 is a cross-sectional view of the structure of an embodiment of a color image forming apparatus according to this invention.

The image forming process and mechanism of an embodiment of a color image forming apparatus of this invention will be explained with reference to FIG. 1 through FIG. 4. FIG. 1 is a cross-sectional view of the structure of an embodiment of a color image forming apparatus according to this invention, FIG. 2 is a side cross-sectional view of the image forming member in FIG. 1, FIG. 3 is a drawing showing the positional relationship between the image exposure means and the developing means of this invention, and FIG. 4 is a drawing showing the decay of the electric potential of the image forming member in the charged condition caused by image exposure.

Figure 2:
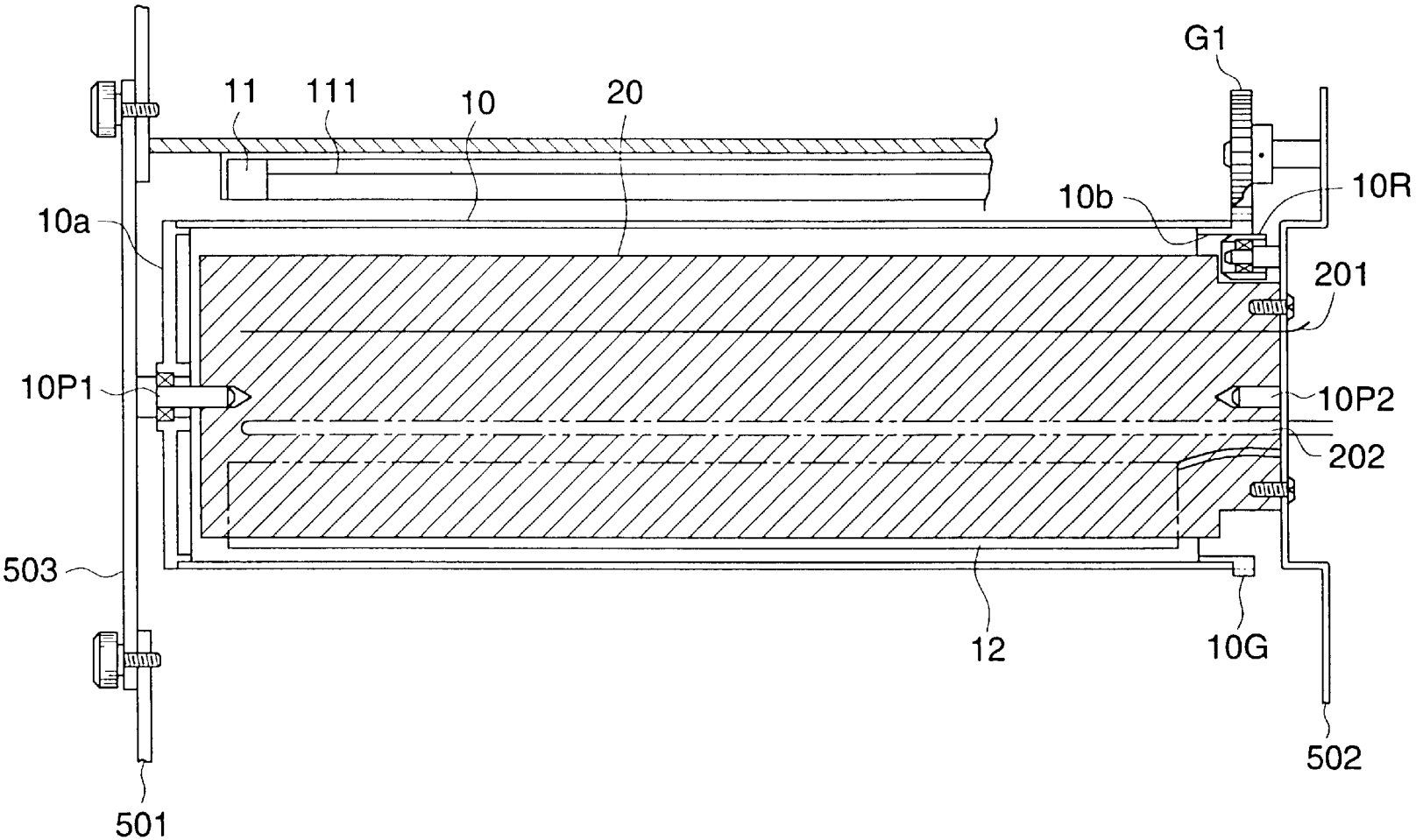
FIG. 2 is a side cross-sectional view of the image forming member in FIG. 1.
Figure 3:
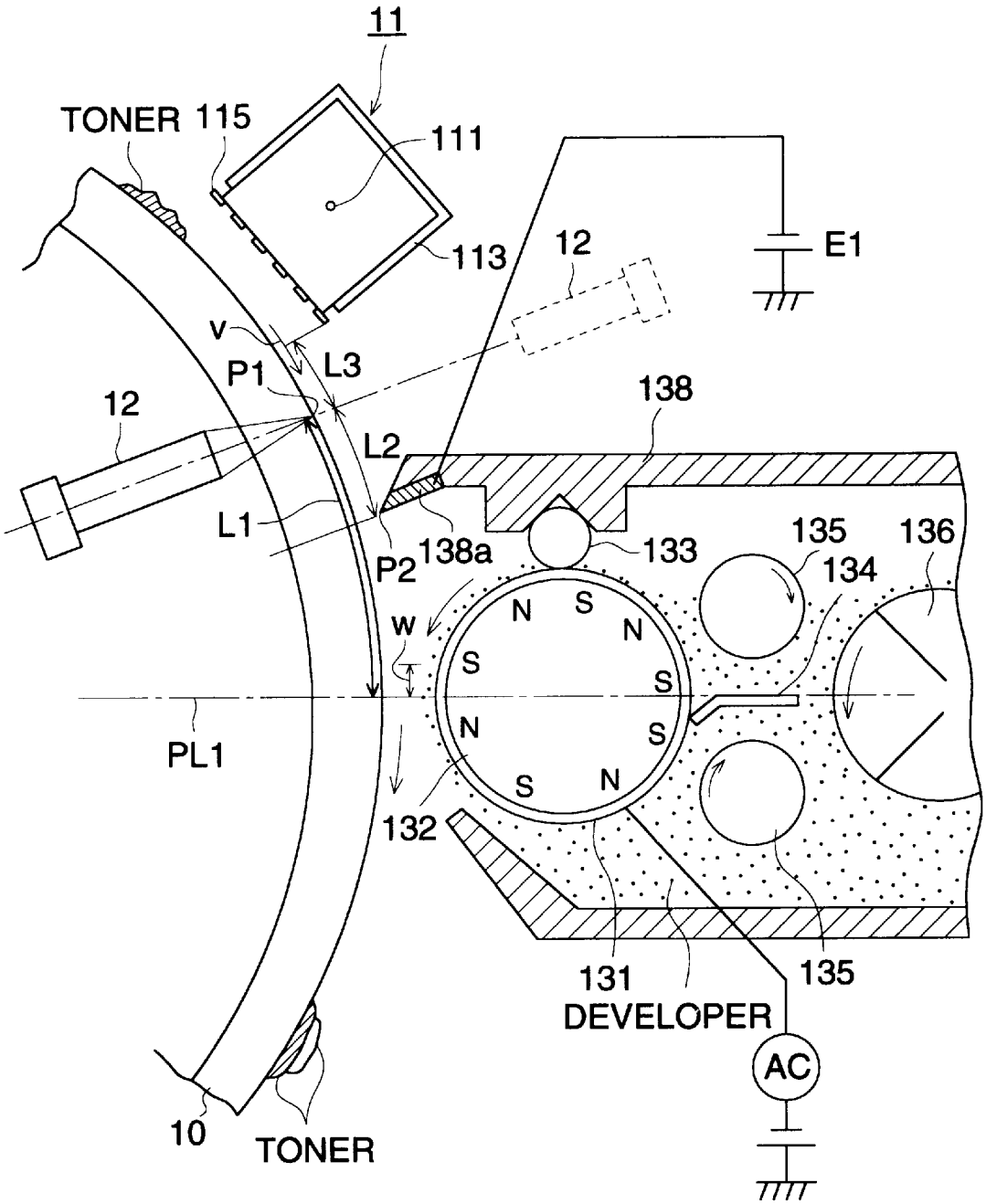
FIG. 3 is a drawing showing the positional relationship between the image exposure means and the developing means of this invention.
Figure 4:
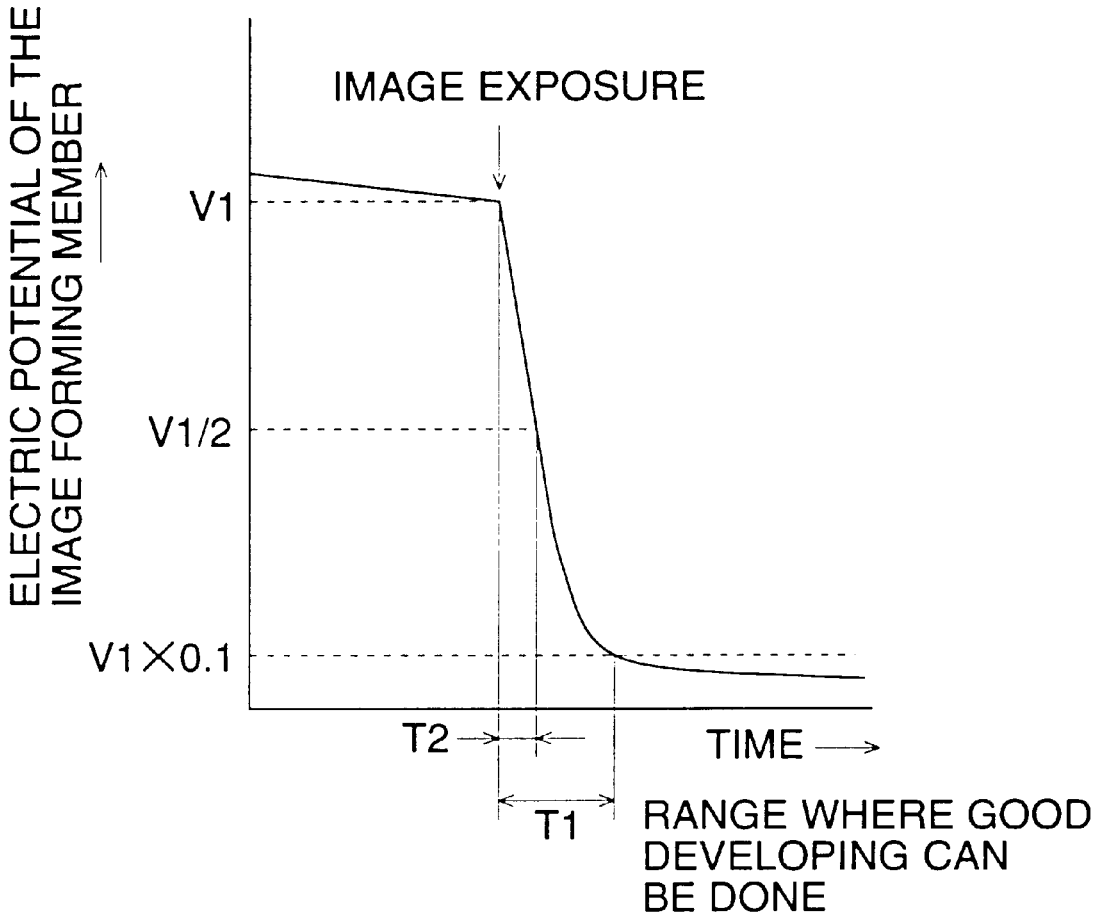
FIG. 4 is a drawing showing the decay of the electric potential of the image forming member in the charged condition caused by image exposure.

According to FIG. 1 through FIG. 3, the photoreceptor drum 10, the image forming member, has a transparent conductive layer and a photoconductive layer made of an organic photosensitive layer (OPC) formed on the outer circumference of a cylindrical substrate formed of a transparent member such as a glass or a transparent acrylic resin, for example. The photoreceptor drum 10 is rotated in the direction shown by the arrow mark in FIG. 1 by the driving force of the driving source not shown in the drawing with the transparent conductive layer grounded.

The photoreceptor drum 10 is held between the front flange 10*a* and rear flange 10*b*, with the front flange 10*a* supported by the guiding pin 10P1 for bearing it provided in the cover 503, which is fixed to the front side panel 501 of the apparatus mainframe, and with the rear flange 10*b* fitted to the outside of the plural guiding rollers 10R fixed to the rear side panel 502 of the apparatus mainframe. The photoreceptor drum 10 is rotated in the clockwise direction shown by the arrow mark in FIG. 1, by the driving force of the gear G1 for driving engaging with the gear 10G provided on the outer circumference of the rear flange 10*b*, with the transparent conductive layer grounded.

In this invention, the photoconductive layer of the photoreceptor drum , which is at the focusing point of the exposing beam for image exposure, has only to be given a exposure light quantity of the wavelength capable of giving a proper contrast to the image for the photo-induced discharging characteristics (photo-carrier generation) of the photoconductive layer. Accordingly, the transmittance of the transparent substrate of the photoreceptor drum in this embodiment is not required to be necessarily 100%, and may be of such a property as to absorb light to some extent at the time of transmitting the exposing beam; in short, it is required for the substrate only to be capable of giving a proper contrast to the image. For the material of the transparent substrate, an acrylic resin, in particular, the one polymerized from methyl methacrylate ester monomer is used favorably for its excellent quality in transparency, strength, accuracy, and surface property. In addition to this, various kinds of transparent resins such as an acrylic, fluorine, polyester, polycarbonate, and polyethylene terephthalate resin used in general optical elements can be used. Further, it may be colored if only it has a transmitting property to the exposing light. For the transparent conductive layer, indium-tin dioxide (ITO), tin dioxide, lead oxide, indium dioxide, copper iodide, and a metallic thin layer having transparency made of Au, Ag, Ni, and Al are used; for the film forming method, vacuum evaporation, reactive vapor deposition, various kinds of sputtering methods, various kinds of CVD methods, dip coating method, spray coating method and so forth are utilized. Further, for the photoconductive layer, various kinds of organic photosensitive layers (OPC) are used.

The organic photosensitive layer as the photoconductive photosensitive layer is made up of two layers, the charge generating layer mainly composed of a charge generating material (CGM) and the charge transporting layer (CTL) mainly composed of a charge transporting material (CTM), to which its function is separated. The organic photosensitive layer made up of two layers has a high durability and is suitable for this invention because of the good thickness of the CTL. In addition, the organic photosensitive layer may be made up of a single layer in which the charge generating material (CGM) and the charge transporting material (CTM) are comprised, and some binder resin is usually comprised in the photosensitive layer made up of said single layer or said two layers.

For the CGM contained in the CGL in the aforesaid organic photosensitive layer made up of two layers of the photoreceptor drum, a metalo- or a metal-free phthalocyanine compound, an azo-compound such as a bisazo-compound and a trisazo compound, a squarium compound, an azulenium compound, a perylene compound, an indico compound, a quinacridone compound, polycyclic quinone compound, a cyanine dye, a xanthene dye, a charge transfer complex composed of a poly-N-vinylcarbazole and a trinitrofluorenone, and so forth can be cited; however, it is not to be confined to these. Further, a mixture of two or more of these compounds may be used at need.

However, in order to accomplish the object of this invention at the highest level, an azo pigment, an azulenium pigment, a phthalocyanine pigment, and a perylene pigment which are sensitive to the light from the light source such as an LED and an LD should be used, and in particular, for the CGM in the OPC photosensitive layer to be sensitive to infrared light (600 nm–850 nm), a copper phthalocyanine pigment, a titanyl phthalocyanine (TiOPc) pigment, and so forth are favorably used.

For the binder resin to be used in the CGL, for example, a polystylene resin, a polyethylen resin, a polypropylene resin, a polyacrylic resin, a polymethacrylic resin, a polyvinyl-chloride resin, a polyvinyl-acetate resin, a polyvinyl-butyral resin, polyepoxy resin, a polyurethane resin, a polyphenol resin, a polyester resin, a polyalkyd resin, a polycarbonate resin, a polysilicone resin, a polymelamine resin, and copolymer resins including two or more of the repeat unit of these resins, such as a copolymer resin of vinyl chloride and vinyl acetate and a copolymer resin of vinyl chloride, vinyl acetate, and maleic anhydride, and further, a high molecular organic semiconductor such as poly-N-vinylcarbazole can be cited, but it should not be confined to these. Among the above, for a favorable binder in the case where an imidazole-perylene compound is used as the CGM, a polyvinyl-butyral resin, and in the case where TiOPc is used as the CGM, a polysilicone resin, polyvinyl-butyral resin, or the mixture of these are to be cited. A polyvinyl-buthylal resin and a polycarbonate resin are excellent in sensitivity, the variation of electric potential in repeated use, and so forth. Regarding these binder resins, any one alone or two or more as a mixture of them can be used.

For the solvent or dispersion medium to be used in forming the CGL, ketone solvents or halogenated solvents are favorably used, making sensitivity, the variation of electric potential in repeated use, and so forth better. Further, regarding these solvents, any one alone or two or more as a mixed solvent of them can be used.

The weight ratio of the CGM to the binder resin in the CGL is to be 100:1–1000, and the film thickness of said CGL is to be 0.01–10 $\mu$m. For the coating method of said CGL, the methods such as blade coating, wiper coating, spray coating, dip coating, and slide hopper coating are cited.

Next, for the CTM contained in the aforesaid CTL, some of hydrazone compounds, styryl compounds, benzidine compounds, stylbene compounds, and so forth are used; for example, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an oxazolone derivative, a benzimidazole derivative, a quinazoline derivative, a benzofuran derivative, an acridine derivative, a phenazine derivative, an aminostylbene derivative, a triarylamine derivative, a phenylenediamine derivative, a stylbene derivative, a benzidine derivative, poly-N-vinylcarbazole, poly-1-vinylpyrene, poly-9-vinylanthracene, and so forth are to be cited, but it should not be limited to these. Further, regarding these any one may be used alone or two or more as a mixture of them may also be used.

For the binder resin used in the aforesaid CTL, a resin properly selected out of a wide range of insulating resins can be used; for example, a polycarbonate resin, a polyacrylate resin, a polyester resin, a polystylene resin, a copolymer resin of stylene-acrylonitryle, a polymethacrylic acid ester resin, a copolymer resin of stylene and metharylic acid ester, and so forth are cited, but it should not be confined to these. Further, as a favorable binder resin, an insulating resin such as a silicone-alkyd resin, a phenol-formaldehyde resin, poly-N-vinyl carbazole, and a polysilane can be cited; regarding these binder resins, any one can be used alone or two or more as a mixture of them may also be used.

The composition ratio of the binder resin to the CTM is to be 1:10–500, and further, it is favorable to be 1:20–150. The film thickness of the CTL is to be 1–100 $\mu$m, and further, it is favorable to be 5–50 $\mu$m.

For the coating method, the same method as the CGL can be used.

Further, an intermediate layer is provided at need between the organic photosensitive layer and the conductive layer; for the intermediate layer for example, a layer of resin having a thickness from 0.01 to 2 $\mu$m is used, the resin being a copolymer of vinylchloride and vinylacetate, a copolymer of vinylchloride, vinylacetate, and maleic acid, an ethylcellulose, a carboxymethylcellulose, an alcohol-soluble polyamide resin of copolymer type or modefied type, and so forth.

The scorotron chargers 11 as the charging means, the exposure units 12 as the image exposure means, the developing units 13 as the developing means to be explained in the following are used respectively in the image forming process for the respective colors, yellow (Y), magenta (M), cyan (C), and black (K); in this embodiment, they are arranged in the order of Y, M, C, and K with regard to the direction of rotation of the photoreceptor drum 10 shown by the arrow mark in FIG. 1.

The scorotron chargers 11 as the charging means are arranged opposite to and in the vicinity of the photoreceptor drum 10 in the direction perpendicular to the direction of moving of the photoreceptor drum 10 (the direction perpendicular to the paper surface in FIG. 1) and carry out the charging process (negative charging in this embodiment) by corona discharging of the same polarity as the toners to give the photoreceptor drum 10 a uniform electric potential, using a wire electrode, for example, for each of the control grid 115, which is kept at a predetermined electric potential against the aforesaid organic photosensitive layer of the photoreceptor drum 10, and the corona discharging electrode 111. For the corona discharging electrode 111, it is possible to use a needle-shaped or sawtooth electrode instead of a wire electrode.

As shown in FIG. 3, the scorotron charger 11 is made up of a U-shaped side plate 113 as a shielding member and a corona discharging electrode 111 comprising a wire electrode, both fitted to a supporting member (not shown in the drawing) at both ends, and further, a control grid 115 fitted to the supporting member corresponding to the corona discharging electrode 111.

Each of the exposure units 12 for the respective colors is made up of a linear exposure element (not shown in the drawing) composed of a plurality of LED's (light emitting diodes) as the image exposing light emitting elements arranged in an array parallel to the axis of the photoreceptor drum 10, and a SELFOC lens (not shown in the drawing) as an image focusing element of 1:1 magnification, both fitted to a holder. The exposure units for the respective colors are fitted to the cylindrical holding member 20, which is fixed by using a guiding pin 10P2 provided in the rear side panel 502 of the apparatus mainframe and a guiding pin 10P1 provided in the cover 503 fitted to the front side panel of it as guiding means, to be accommodated inside the cylindrical substrate of the photoreceptor drum 10. For the exposure element, a linear one having a plurality of light emitting elements such as FL (fluorescent luminescence), EL (electro-luminescence), and PL (plasma luminescence) elements can be used instead of the above.

The exposure units 12 as the image exposure means for the respective colors are disposed inside the photoreceptor drum 10, with the exposure positions on the photoreceptor drum 10 positioned respectively between the scorotron chargers 11 and the developing units 13 and in the upstream side of the developing units 13 in the direction of rotation of the photoreceptor drum 10.

The exposure units 12 carry out the image exposure for the uniformly charged photoreceptor drum 10 to form a latent image on the photoreceptor drum 10, on the basis of the image data of the respective colors transmitted from a separately provided computer (not shown in the drawing) and memorized in a memory, after the image data being subjected to image processing. The wavelength of the light emitting element used in this embodiment should favorably be in the range of 680–900 nm to which the toners of Y, M, and C have a high transmittance; however, the wavelength shorter than the above, to which the color toners have not enough transmittance, may be appropriate because the image exposure is carried out from the rear surface.

The developing units 13 as the developing means for the respective colors receive the two-component (single component may also be appropriate) developers of yellow (Y), magenta (M), cyan (C), and black (K) inside respectively, and each of them is provided with the cylindrical developing sleeve 131 as a developer bearing member made of stainless steel or aluminum having a thickness of 0.5 mm–1 mm and an outer diameter of 15 mm–25 mm, for example. As shown in FIG. 3, the fixed magnet 132 is contained in the developing sleeve 131, with the N- and S- magnetic poles arranged alternately, and fixed at the concentric position with the developing sleeve to cause a magnetic force to act on the developers borne on the peripheral surface of the non-magnetic sleeve. The thin layer forming bar 133 as the thin layer forming member is a member for regulating the layer thickness of the two-component developer on the peripheral surface of the developing sleeve 131, is made up of a magnetic metal bar having a circular cross section with a diameter of 3 mm–10 mm, and is pressed to contact with the peripheral surface of the developing sleeve 131 uniformly with a predetermined load. The scraper 134 as the removing means for removing the two-component developer from on the developing sleeve 131 is made up of a plate-shaped elastic member made of SUS, urethane rubber, etc., which is installed with one of the longer sides of the belt-shaped member pressed parallel to the developing sleeve 131. The stirring screws 136 and 137 shown to FIG. 1, rotate in the reverse direction with an equal speed to each other, so that they may stir and mix the toner and carrier particles in the color developing unit 13 to make a two-component developer containing the predetermined toner content uniformly. Further, the feeding rollers 135 feed the two-component developer to the stirring portion, and therefrom the developer is transported and fed to the developing zone of the developing sleeve 131. 138 is the development casing.

In the developing zone, the developing sleeve is kept to be in a non-contact condition with a predetermined spacing of, for example, 100 $\mu$m–1000 $\mu$m to the photoreceptor drum 10 by a rolling bar spacer (not shown in the drawing), and rotates in the same direction in a manner such that the moving direction in the zone is the same as that of the photoreceptor drum 10; the non-contact reverse development is carried out for the exposed area of the photoreceptor drum 10, by applying to the developing sleeve 131 a direct current voltage having the same polarity as the toner (negative polarity in this embodiment) or the direct current voltage with an alternate current voltage superposed on it as a developing bias voltage. In this case, the deviation of the developing spacing is required to be not larger than about 20 $\mu$m in order to prevent unevenness of the image.

As stated above, the developing unit 13 makes reverse development for the latent electrostatic image formed on the photoreceptor drum 10 of the charge by the scorotron charger 11 exposed to the image exposure light of the exposure unit 12, in a non-contact condition with the toner having the same polarity as the charging polarity of the photoreceptor drum 10 (the photoreceptor drum is negatively charged, accordingly the toner is negatively charged in this embodiment).

When the image forming process starts, it is rotated the gear 10G provided in the rear flange 10*b* of the photoreceptor drum 10 by the actuation of the photoreceptor driving motor, not shown in the drawing, through the gear G1 for driving to rotate the photoreceptor drum 10 in the clockwise direction shown by the arrow mark in FIG. 1; at the same time, the process to give the electric potential to the photoreceptor drum 10 starts with the charging action of the scorotron charger 11 (Y). After the electric potential is given to the photoreceptor drum 10, the exposure process starts in the exposure unit 12 (Y) on the basis of the electric signal corresponding to the first color signal, that is, the image data for Y, forming a latent electrostatic image corresponding to the original image of yellow (Y) on the photosensitive layer of the surface of the drum 10 with the rotational scanning of the drum. This latent image is reverse-developed in the non-contact condition by the developing unit 13 (Y), and the toner image of yellow (Y) is formed on the photoreceptor drum 10.

Next, the photoreceptor drum 10 is given the electric potential on the aforesaid toner image of yellow (Y) by the charging action of the scorotron charger 11 (M), subjected to the exposure based on the electrical signal corresponding to the first color signal, that is, the image data of magenta (M), forming the toner image of magenta (M) superposed on said toner image of yellow (Y) through the non-contact reverse development by the developing unit 13 (M).

Through the like process, further the toner image of cyan (C) corresponding to the third color signal and the toner image of black (K) corresponding to the fourth color signal are sequentially formed, superposed on the former ones, by the scorotron charger 11 (C), the exposure unit 12 (C), and the developing unit 13 (C), and by the scorotron charger 11 (K), exposure unit 12 (K), and the developing unit 13 (K) respectively, forming a color toner image on the peripheral surface of the photoreceptor 10 within one rotation of it.

As stated in the above concerning this embodiment, the exposure for the organic photosensitive layer of the photoreceptor drum 10 by the exposure units 12 for Y, M, C, and K is carried out from inside the photoreceptor drum 10 through the transparent substrate. Accordingly, this method is favorable because any one of the exposures corresponding to the second, third, and fourth color signals is made possible to form the latent electrostatic image without being intercepted by the toner images formed before; however, the exposure from outside the photoreceptor drum may also be appropriate.

On the other hand, the recording paper P as the transfer material is conveyed out from the paper feeding cassette 15 as the transfer material receiving means by the conveying-out roller (without sign), and is transported by the transporting rollers (without sign) to the timing roller 16.

The recording paper P is transported to the transfer zone, attracted to the transporting belt 14D owing to the charging by the paper charging unit 14C as the paper charging means, in synchronism with the color toner images borne on the photoreceptor drum 10 by the driving of the timing roller 16. Onto the recording paper P, which is transported by the transporting belt 14D, closely attracted to the belt, the color toner images on the peripheral surface of the photoreceptor drum 10 are transferred together all at a time by the transfer unit 14A as the transfer means to which a voltage of reverse polarity to the toner (positive polarity in this embodiment) is applied in the transfer zone.

The recording paper P, onto which the color toner images are transferred, is subjected to the charge eliminating process by the AC charge eliminating unit 14B for paper picking-off as the transfer material picking-off means, picked off from the transporting belt 14D, and is transported to the fixing unit 17 as the fixing means. Then, the attracted toner particles on the recording paper are fixed by the application of heat and pressure between the fixing roller 17*a* containing a heater (not shown in the drawing) inside and the pressing roller 17*b,* and the recording paper P is transported by the paper ejecting roller 18 to be ejected onto the tray at the upper portion of the apparatus mainframe.

The toner particles remaining on the peripheral surface of the photoreceptor drum 10 after transfer is cleaned off by the cleaning blade 19*a* provided in the cleaning unit 19 as the cleaning means. The photoreceptor drum 10, with the remaining toner particles removed, is subjected to the uniform charging by the scorotron charger 11 and enters into the next image forming cycle.

In the following, the structure of this invention to accomplish the first object of it will be explained.

According to FIG. 3, the exposure units 12 are disposed inside the photoreceptor drum 10, with the exposure positions on the photoreceptor drum 10 arranged respectively between the scorotron chargers 11 and the developing units 13 and in the upstream side of the developing units 13 in the direction of rotation of the photoreceptor drum 10.

Now referring to FIG. 3 and FIG. 4, regarding the development in the condition that there are toner particles attracted on the photoreceptor drum 10, for the charging potential V1 of the photoreceptor drum 10 before the image exposure, with the image focusing position set on the photosensitive layer on the surface of the substrate, it is necessary that the development is to be done after the charging potential of the image exposed area decreases from the initial value V1 to a sufficiently low value, the decrement of the electric potential reaching to the 90% or more, that is, it should be done after the electric potential becomes V1×0.1 or lower where the electric potential is sufficiently lowered. In the case of the image forming member made up of an organic photosensitive layer, there is a tendency that the time for the electric potential to be lowered is longer as compared with the inorganic photosensitive layers because of the low mobility of the charge carrier; hence, a particular consideration should be necessary. Let T1 be the time period after the image exposure is carried out until the electric potential becomes V1×0.1, then $$(L1-w)/v>T1,$$

where w is the width of the developing zone where development is done from the central line of development PL1 passing through the developing position, L1 is the distance on the photoreceptor drum 10 from the image exposure position P1 to the central line of development PL1 passing through the developing position, and v is the peripheral speed of the photoreceptor drum 10. By this inequality condition, the electric potential of the exposed area can be lowered sufficiently, and development with a good image quality can be done.

Further, let T2 be the time period after image exposure until the electric potential becomes (½)×V1. Incidentally, the toner particles having been present at the image exposed area beforehand do not instantaneously be scattered until the electrical attractive force is made weak owing to the lowering of the electric potential. When decrement of the electric potential after the image exposure comes to a half or more, that is, the electric potential becomes (½)×V1 or lower, the toner particle scattering from the toner image occurs. Because of this, it is required that the image exposed area on the photoreceptor drum 10 reaches the edge portion P2 at the side neighboring the exposure unit 12 of the development casing 138, before the electric potential of the photoreceptor drum 10 decays to (½)×V1, so that the scorotron charger 11 which is disposed in the vicinity of the exposure unit 12 and the exposure unit in the case where it is disposed outside the photoreceptor drum 10 shown by dotted lines in FIG. 3 should not be smudged by the toner particles scattered inside the machine owing to the decrease of the electric potential. In other words, it is required that the electric potential should be higher than (½)×V1, in which condition the electric potential is considered to be not lowered to a level such that the toner particles are scattered. Accordingly, for the peripheral speed v of the photoreceptor drum 10, let L1 be the distance on the photoreceptor drum 10 from the image exposure position P1 to the central line of development PL1 passing through the developing position, and L2 be the distance on the photoreceptor drum 10 from the image exposure position P1 to the edge portion P2 at the side neighboring the exposure unit 12 of the development casing 138, then $$L2/v<T2.$$

Further, for the reasons that in the organic photoreceptors generally T2≦(T1)/2, and of the condition that the value of (L1−w)/v is almost equal to the value of (L1)/v, the above inequality is changed to give $$L2<(½)\times L1.$$

This makes the favorable condition that the toner scattering does not occur until the image exposed area enters the developing means, and that the electric potential is sufficiently lowered at the developing position. Further, owing to this, the photoreceptor drum is made small-sized, which causes the apparatus to be made small-sized.

Further, it is favorable that the distance from the image exposure position P1 to the end portion of the side plate of the scorotron charger 11 is as short as possible; Let L3 be the distance on the photoreceptor drum 10 from the image exposure position P1 to the end portion near the exposure unit 12 of the side plate of the scorotron charger 11, and L2 be the distance on the photoreceptor drum 10 from the image exposure position P1 to the end portion near the exposure unit 12 of the development casing 138, then it is favorable to establish the following relationship:

$$L3\leqq L2;$$

that is, by making the distance L3 smaller than the distance L2, the photoreceptor drum 10 is made small-sized, which causes the apparatus to be made small-sized.

Further, as shown in FIG. 3, the shielding member for the scattered toner particle 138*a,* to which it is applied the direct current development casing bias voltage E1 of the same polarity as the toner (negative polarity in this embodiment), is provided at the end portion close to the photoreceptor drum 10 of the development casing 138, so that the scattering of the toner inside the developing unit 13 from on the image forming member and the scattering of the toner, which is scattered into the developing unit, further to the outside of the development casing 138 may be prevented.

According to this invention, the apparatus is made small-sized, and the toner scattering from the toner image formed previously owing to the lowering of the electric potential is restricted inside the developing means to prevent the smudge of the charging means. Further, in the case where the image exposure means are provided outside the image forming member, the smudge of the image exposure means owing to the toner scattering also is prevented.

Figure 5:
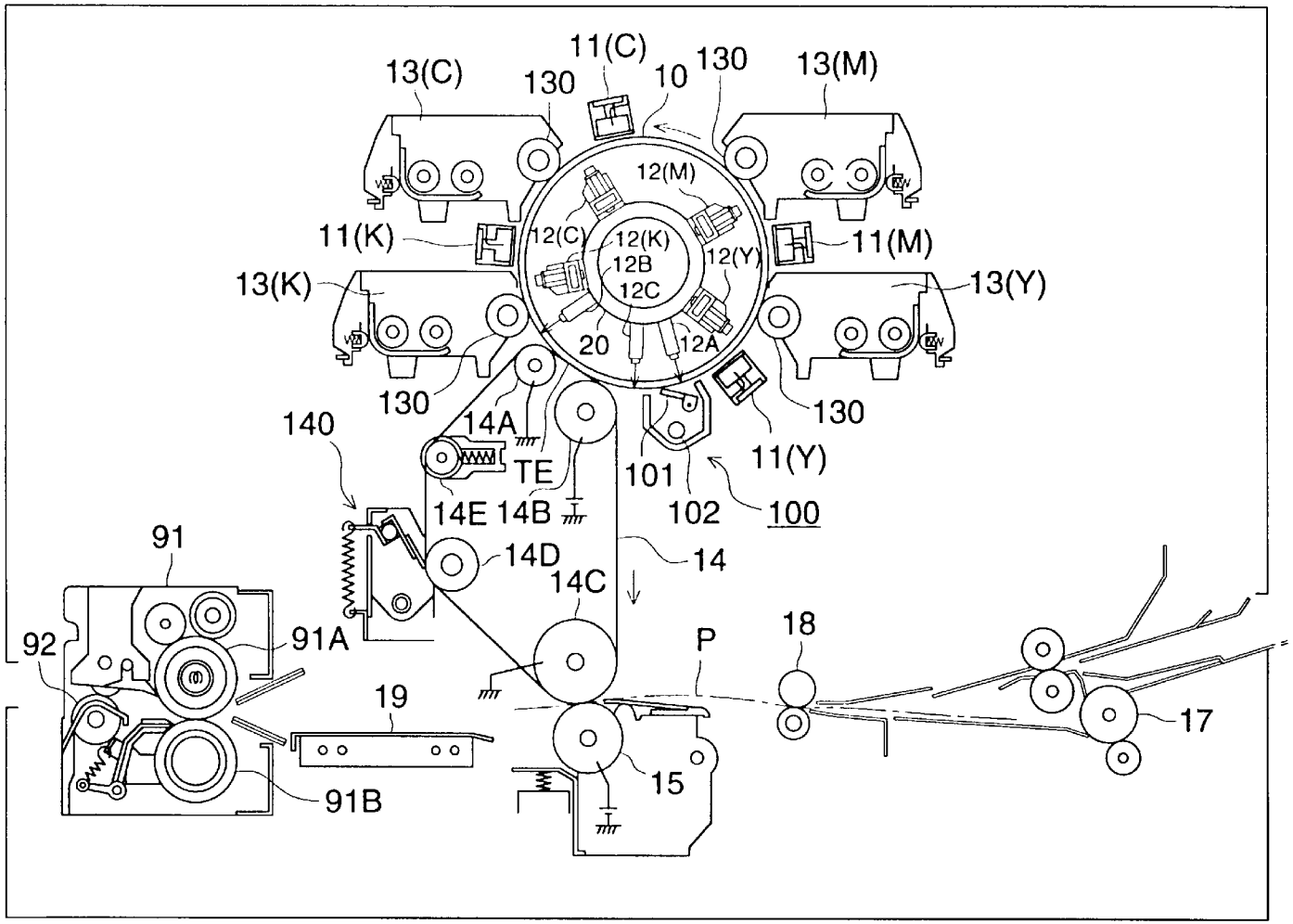
FIG. 5 is a cross-sectional view showing the structure of an embodiment of a color image forming apparatus to which this invention is applied.

In the following, the structure to accomplish the second and third objects of this invention will be explained, taking the image forming apparatus shown in FIG. 5 for instance. In the following explanation, it is employed the image forming method wherein the color toner image formed on the image forming member is once transferred to an intermediate transfer member and then the color toner image is further transferred to a recording material; however, it may be appropriate that the color toner image on the image forming member is directly transferred to the recording material without using the intermediate transfer member. Accordingly, the transfer process using the intermediate transfer member as the transfer means will be explained in this explanation, but it is applicable also to the transfer process made by using the transfer member as the transfer means for directly transferring the image from the image forming member to the recording material.

Figure 6:
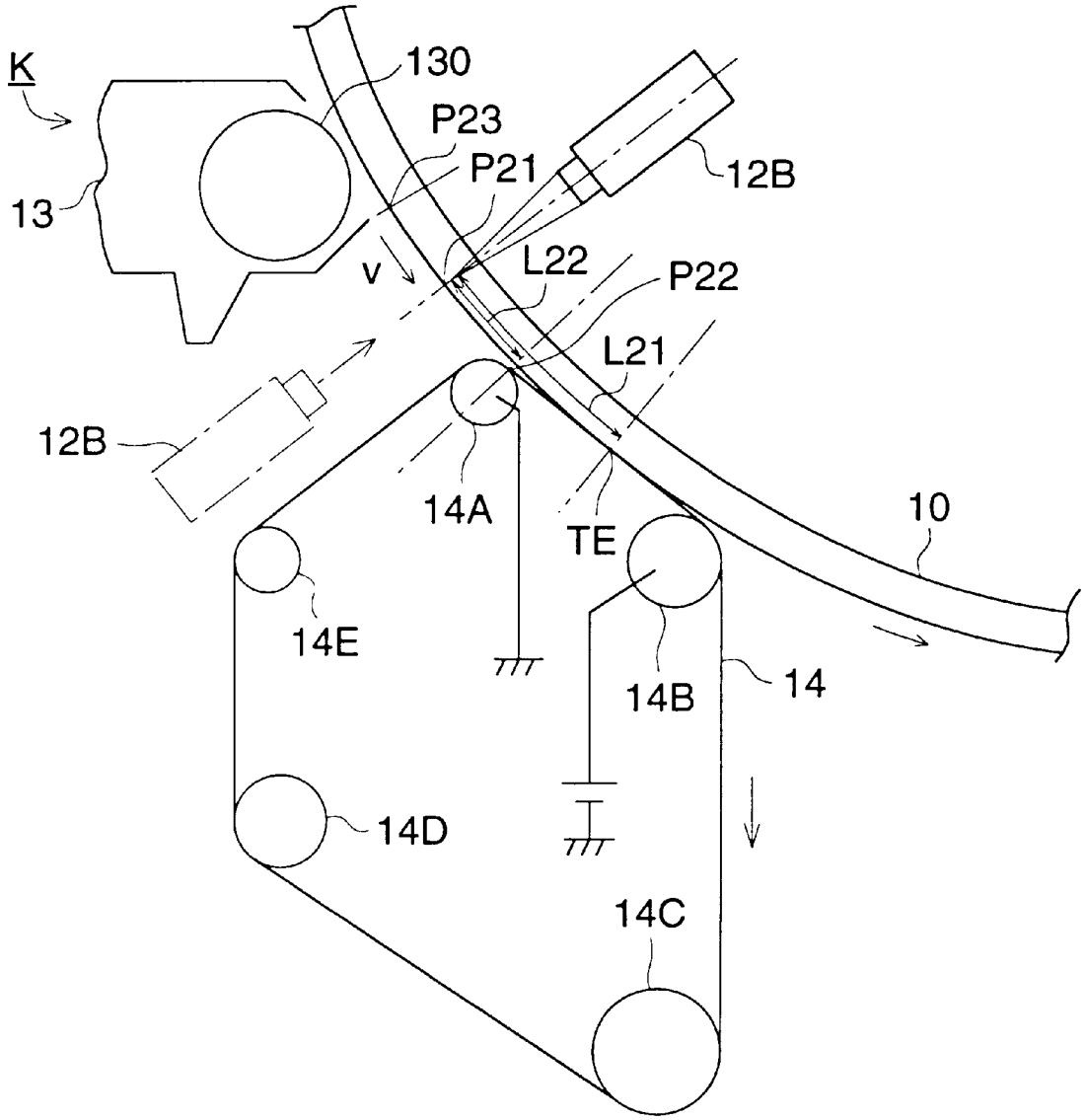
FIG. 6 is a drawing illustrating the arrangement of the pre-transfer exposure means.
Figure 7:
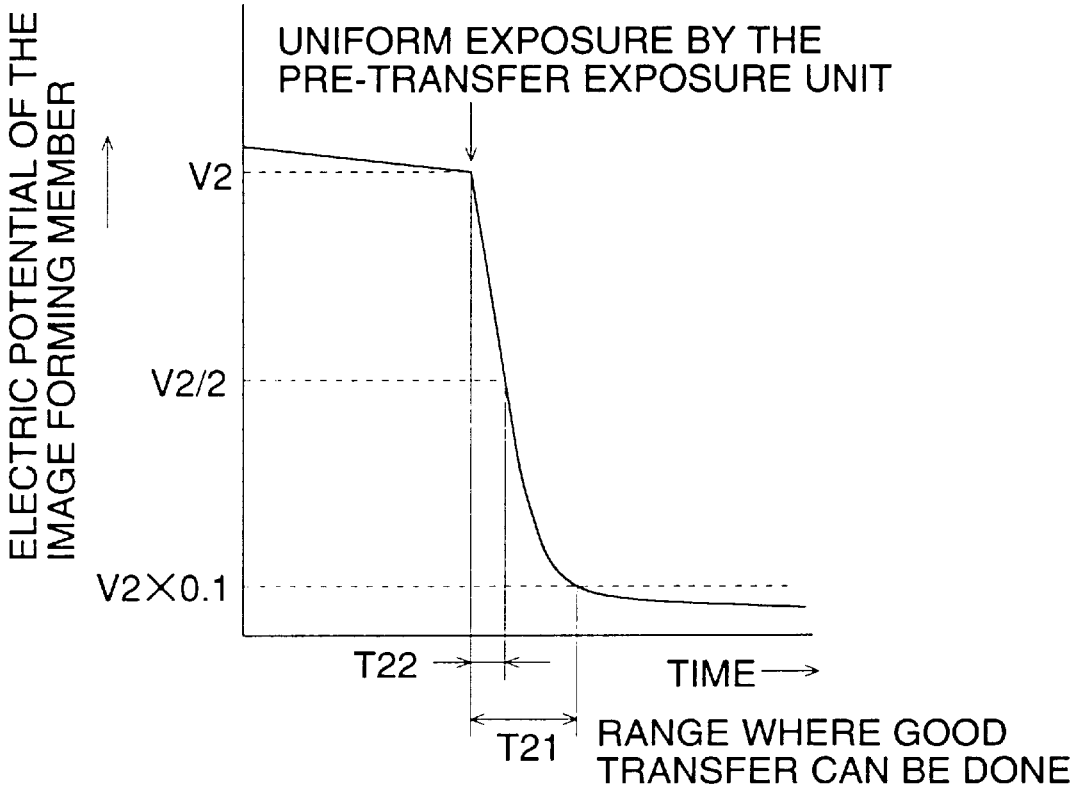
FIG. 7 is a drawing showing the decay of the electric potential of the image forming member caused by the uniform exposure in the pre-transfer exposure means.

With reference to FIG. 6 and FIG. 7, the structure to accomplish the second object will be explained. FIG. 6 is an illustration of the arrangement of the pre-transfer exposure means, and FIG. 7 is a drawing showing the decay of the electric potential of the image forming member owing to the uniform exposure by the pre-transfer exposure means.

According to FIG. 6, the pre-transfer exposure unit 12B is disposed in a manner such that the exposure position on the photoreceptor drum 10 comes between the end portion P23 near the intermediate transfer belt 14 of the developing unit 13 for K disposed at the most downstream position in the direction of rotation of the photoreceptor drum 10 (the point at which the straight line connecting the center of the photoreceptor drum 10 and the end point near the intermediate transfer belt 14 of the developing unit 13 for K intersects the surface of the photoreceptor drum 10), and the central position P24 of the grounded roller 14A around which the intermediate belt 14 is entrained (the point at which the straight line connecting the center of the photoreceptor drum 10 and the center of the grounded roller 14A intersects the surface of the photoreceptor drum 10). As stated in the foregoing, the transfer means in this embodiment is composed of the intermediate transfer belt 14 and the intermediate transfer roller 14B, and the intermediate transfer belt 14 forms the transfer portion TE for transferring the color toner image on the photoreceptor drum 10 to it, with the central portion of its part entrained between the grounded roller 14A and the intermediate transfer roller 14B pressed to contact with the peripheral surface of the photoreceptor drum 10.

For the highest electric potential V2 of the exposed area of the photoreceptor drum 10 when the uniform exposure by the pre-transfer exposure unit 12B is carried out with the focusing position set at the photosensitive layer on the substrate surface, it is necessary that the transfer process in the condition that the electric charge is present on the photoreceptor drum 10 is done after the electric potential V2 of the area where there is no color toner image is lowered sufficiently to a level that the decrement percentage of the electric potential becomes equal to or larger than 90%, that is, the transfer process should be done after the electric potential becomes equal to or lower than V2×0.1 where it is low enough. In the case of organic photosensitive layers, there is a tendency that the time period for the electric potential to become lowered is longer as compared with the inorganic photosensitive layers owing to the low mobility of the charge carrier, and it is necessary to consider that particularly.

Let T21 be the time period after the uniform exposure by the pre-transfer exposure unit 12B is carried out until the electric potential becomes V2×0.1, then $$(L21)/v > T21,$$

where L21 is the distance on the peripheral surface of the photoreceptor drum 10 from the image focusing position P21 of the pre-transfer exposure unit 12B to the transfer position (transfer portion TE) of the aforesaid transfer means, and v is the peripheral speed of the photoreceptor drum 10. By this condition, the electric potential of the exposed area can be made sufficiently lowered, and good transfer is achieved.

Further, let T22 be the time period after uniform exposure is carried out until the electric potential of the photoreceptor drum 10 becomes (½)×V2. The color toner image which has been present at the exposed area of the photoreceptor drum 10 does not be scattered instantaneously until the electrical attractive force is weakened owing to the lowering of the electric potential. When the electric potential is lowered to a level equal to or lower than a half of V2, i.e., (½)×V2 owing to the uniform exposure, toner particle scattering from the toner image occurs. For this reason, it is required that the exposed area on the photoreceptor drum 10 reaches the central position P22 of the grounded roller 14A (the point at which the straight line connecting the center of the photoreceptor drum 10 and the center of the grounded roller 14A intersects the surface of the photoreceptor drum 10) before the electric potential of the photoreceptor drum 10 decays to (½)×V2, so that the inside of the machine should not be smudged, and so that the pre-transfer exposure unit 12B shown by the dotted lined in FIG. 6 in the case where it is disposed outside the photoreceptor drum 10 should not be smudged, by the toner particles scattered owing to the lowering of the electric potential. That is, it is required that the electric potential is higher than (½)×V2 at which it is not so lowered as the toner particles are scattered when the exposed area of the photoreceptor drum 10 passes the central position P22 of the grounded roller 14A around which the intermediate transfer belt 14 is entrained. Accordingly, for the peripheral speed v of the photoreceptor drum 10, let L21 be the distance on the peripheral surface of the photoreceptor drum 10 from the focusing position P21 of the pre-transfer exposure unit 12B to the transfer position (transfer portion TE) of the aforesaid transfer means, and L22 be the distance on the peripheral surface of the photoreceptor drum 10 from the pre-transfer exposure unit 12B to the end portion at the upstream side in the direction of rotation of the photoreceptor drum 10 of said transfer means, i.e., the central position P22 of the grounded roller 14A (the point at which the straight line connecting the center of the photoreceptor drum 10 and the center of the grounded roller 14A intersects the surface of the photoreceptor drum 10), then $$(L22)/v < T22$$

should be established. Further, for the reasons that in the organic photosensitive layers generally T22≦(T21)/2 and of the foregoing conditional inequality: T21<(L21)/v, the above inequality is changed to give $$L21 < (½) \times L11.$$

This makes the favorable condition that the toner scattering does not occur until the exposed area enters the transfer means, and that the electric potential is sufficiently lowered at the transfer position. Further, it becomes possible that the developing unit 13 for K and the intermediate transfer belt 14 are disposed close to each other; hence, the photoreceptor drum is made small-sized, which causes the apparatus to be made small-sized.

According to the above, the apparatus is made small-sized, and the color toner image on the image forming member is transferred before the color toner image, of which the attractive force is weakened owing to the lowering of the electric potential of the image forming member after the uniform exposure by the pre-transfer exposure means (charge elimination by light), is scattered, so that the smudging inside the machine caused to occur by the toner scattering may be prevented. Further, in the case where the pre-transfer exposure means is provided outside the image forming member, the smudging of the pre-transfer exposure means by the toner scattering can also be prevented.

Figure 8:
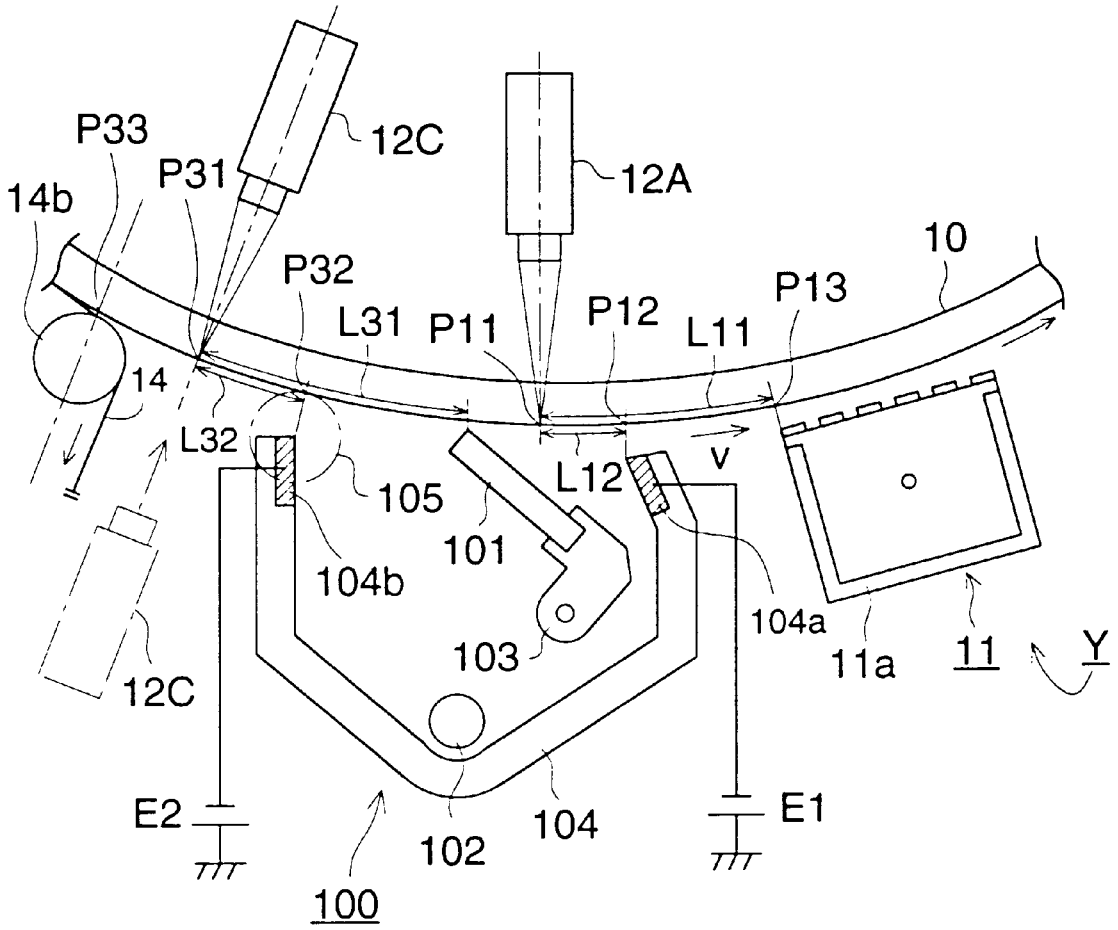
FIG. 8 is a drawing illustrating the arrangement of the pre-charging exposure means and the pre-cleaning exposure means.
Figure 9:
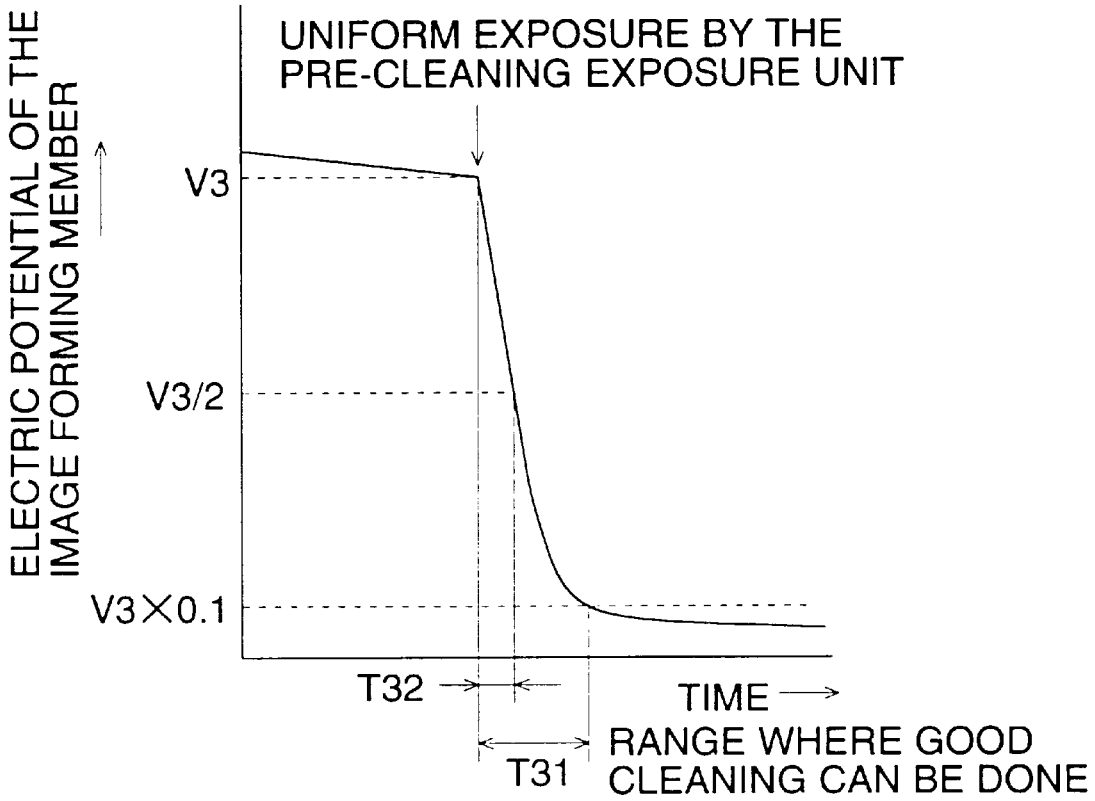
FIG. 9 is a drawing showing the decay of the electric potential of the image forming member caused by the uniform exposure in the pre-cleaning exposure means.

In the following, the structure to accomplish the third object of this invention will be explained with reference to FIG. 8 and FIG. 9. FIG. 8 is a drawing illustrating the arrangement of the pre-charging exposure means and the pre-cleaning exposure means. FIG. 9 is a drawing showing the decay of the electric potential caused by the uniform exposure in the pre-cleaning exposure means.

According to FIG. 8, the pre-cleaning exposure unit 12C is disposed in a manner such that the exposure position on the photoreceptor drum 10 comes between the central position P33 of the intermediate transfer roller 14B around which the intermediate transfer belt 14 is entrained, said roller 14B being disposed at the upstream position of the cleaning unit 100 in the direction of rotation of the photoreceptor drum 10, (the point at which the straight line connecting the center of the photoreceptor drum 10 and the center of the intermediate transfer roller 14B intersects the surface of the photoreceptor drum 10), and the end portion of the cleaning unit 100 near the intermediate transfer belt 14.

For the highest electric potential V2 of the exposed area of the photoreceptor drum 10 when the uniform exposure by the pre-cleaning exposure unit 12*c* is carried out with the focusing position set at the photosensitive layer on the substrate surface, it is necessary that the transfer process in the condition that the electric charge is present on the photoreceptor drum 10 is done after the electric potential V3 of the area where there is no color toner image is lowered sufficiently to a level such that the decrement percentage of the electric potential becomes equal to or larger than 90%, that is, the transfer process should be done after the electric potential becomes equal to or lower than V3×0.1 where it is low enough. In the case of organic photosensitive layers, there is a tendency that the time period for the electric potential to become lowered is longer as compared with the inorganic photosensitive layers owing to the low mobility of the charge carrier, and it is necessary to consider that particularly.

Let T31 be the time period after the uniform exposure by the pre-transfer exposure unit 12C is carried out until the electric potential reaches to V3×0.1, then $$(L31)/v > T31,$$

where L31 is the distance on the peripheral surface of the photoreceptor drum 10 from the focusing position P31 of the pre-cleaning exposure unit 12C to the position where the cleaning blade 101 of the cleaning unit 100 is pressed to contact with the photoreceptor drum 10, and v is the peripheral speed of the photoreceptor drum 10. By this condition, the electric potential of the exposed area can be made sufficiently lowered, and good cleaning is achieved.

Further, let T32 be the time period after uniform exposure until the electric potential of the photoreceptor drum 10 becomes (½)×V3. Incidentally, the color toner image which has been present at the exposed area of the photoreceptor drum 10 does not be scattered instantaneously until the electrical attractive force is weakened owing to the lowering of the electric potential. When the electric potential is lowered to a level equal to or lower than a half of V3, i.e., (½)×V3, toner particle scattering from the remaining toner particles after transfer occurs. For this reason, it is required that the exposed area on the photoreceptor drum 10 reaches the end portion P32 of the cleaning casing 104 of the cleaning unit 100 near the intermediate transfer belt 14 before the electric potential of the photoreceptor drum 10 decays to (½)×V3, so that the inside of the machine should not be smudged, and so that the pre-transfer exposure unit 12C shown by the dotted lined in FIG. 8 in the case where it is disposed outside the photoreceptor drum 10 should not be smudged, by the toner particles scattered owing to the lowering of the electric potential. That is, it is required that the electric potential is higher than (½)×V3 so that the remaining toner particles after transfer may be carried into the inside of the cleaning unit 100, the potential being not so lowered as the toner particles are scattered, when the exposed area of the photoreceptor drum 10 passes the end portion P32 near the intermediate transfer belt 14 of the cleaning casing 104 of the cleaning unit 100. Accordingly, for the peripheral speed v of the photoreceptor drum 10, let L31 be the distance on the peripheral surface of the photoreceptor drum 10 from the image focusing position P31 of the pre-cleaning exposure unit 12C to the position where the cleaning blade 101 of the cleaning unit 100 is pressed to contact with the photoreceptor drum 10, and L32 be the distance on the peripheral surface of the photoreceptor drum 10 from the focusing position of the pre-cleaning exposure unit 12C to the end portion P32 of the cleaning casing 104 of the cleaning unit 100 at the upstream side in the direction of rotation of the photoreceptor drum 10 (the point at which the straight line connecting the center of the photoreceptor drum 10 and the end portion of the cleaning casing 104 near the intermediate transfer belt 14 at the most upstream position in the direction of rotation of the photoreceptor drum 10 intersects the surface of the photoreceptor drum 10), then $$(L32)/v < T32$$

should be established. Further, for the reasons that in the organic photosensitive layers generally T33≦(T31)/2 and of the foregoing conditional inequality: T31<(L31)/v, the above inequality is deformed to give $$L32 < (1/2) \times L31.$$

This makes the favorable condition that the toner scattering does not occur until the exposed area enters the cleaning means, and that the electric potential is sufficiently lowered at the cleaning position where the cleaning blade 101 is pressed to contact with the photoreceptor drum 10. Further, owing to this, the photoreceptor drum is made small-sized, which causes the apparatus to be made small-sized.

Further, as shown in FIG. 8, the shielding member for the scattered toner particles 104*b*, to which it is applied the direct current cleaning casing bias voltage E2 of the same polarity as the toner (negative polarity in this embodiment), is provided at the end portion of the cleaning casing 104*b* positioned near the intermediate transfer belt 14 close to the photoreceptor drum 10, so that the scattering of the toner particles inside the cleaning unit 100 from on the photoreceptor drum 10 and the scattering of the toner particles, which are scattered in the cleaning portion, further to the outside of the cleaning casing 104 of the cleaning unit 100 may be prevented. Further, it is possible that the cleaning roller 105 shown by the single dot and dash line in FIG. 8 is provided at the end portion of the cleaning casing 104 near the intermediate transfer belt 14 instead of the shielding member 104*b* for the scattered toner particles to prevent the toner scattering to the outside of the cleaning casing 104 of the cleaning unit 100.

According to the above, the apparatus is made small-sized, and the scattering of the remaining toner particles after transfer, of which the attractive force is weakened owing to the lowering of the electric potential of the image forming member after the uniform exposure by the pre-cleaning exposure means (charge elimination by light), is restricted within the inside of the cleaning means, so that the smudging inside the machine caused to occur by the scattering of the toner particles remaining after transfer may be prevented. Further, in the case where the image exposure means is provided outside the image forming member, the smudging of the image exposure means by the toner scattering can also be prevented.

Regarding the above-mentioned structures to accomplish the first through third objects, each of them may be employed separately or any two or all of them may be employed together; in the case where two or all are employed, a synthetically good result can be obtained.

According to this invention, the apparatus is made small-sized, and the color toner image on the image forming member is transferred before the color toner image, of which the attractive force is weakened owing to the lowering of the electric potential of the image forming member after the uniform exposure by the pre-transfer exposure means (charge elimination by light), is scattered, so that the smudging inside the machine caused to occur by the toner scattering may be prevented. Further, in the case where the pre-transfer exposure means is provided outside the image forming member, the smudging of the pre-transfer exposure means by the toner scattering can also be prevented.

Further, the scattering of the remaining toner particles after transfer, of which the attractive force is weakened owing to the lowering of the electric potential of the image forming member after the uniform exposure by the pre-cleaning exposure means (charge elimination by light), is restricted within the inside of the cleaning means, so that the smudging inside the machine caused to occur by the scattering of the toner particles remaining after transfer may be prevented. Further, in the case where the image exposure means is provided outside the image forming member, the smudging of the image exposure means by the toner scattering can also be prevented.

What is claimed is:

1. A color image forming apparatus, comprising:

an image forming member having a rotatable peripheral surface on which an organic photoconductor is provided;

plural sets of charging means, imagewise exposure means, and developing means, the charging means charging the peripheral surface of the image forming member, the imagewise exposure means imagewise exposing a portion of the peripheral surface at an imagewise exposing position so as to form a latent image and the developing means developing the image at a developing position so as to form a toner image on the peripheral surface;

wherein each set of the plural sets is provided separately from other sets around the peripheral surface of the image forming member so that plural color component images are formed one after another by the plural sets and are superimposed so as to form a color image on the peripheral surface during a single rotation of the peripheral surface, and wherein the developing means has a casing and the imagewise exposure means and the developing means of each set are arranged such that the portion on the peripheral surface located at the imagewise exposing position moves into the casing of the developing means before the electric-potential of the portion is lowered to half of V1 (V1/2), where V1 is the electric potential on the peripheral surface located at the imagewise exposing position.

2. The color image forming means of claim 1, wherein an electric bias having the same polarity as that of toner is applied to an edge of the casing of the developing means at an imagewise exposure means-side.

3. The color image forming means of claim 1, wherein:

the distance on the peripheral surface between the imagewise exposing position by the imagewise exposure means and the developing position by the developing means is L1, the distance on the peripheral surface between the imagewise exposing position by the imagewise exposure means and an edge of the housing of the developing means at the imagewise exposure means-side is L2, and L1 and L2 are set to satisfy the following relation:

$$L2<(1/2)\times L1.$$

4. The color image forming means of claim 1, wherein:

the charging means has a housing, the distance on the peripheral surface between the imagewise exposing position by the imagewise exposure means and an edge of the housing of the developing means at the imagewise exposure means-side is L2, the distance on the peripheral surface between the imagewise exposing position by the imagewise exposure means and an edge of the housing of the charging means at the imagewise exposure means-side is L3, and

L2 and L3 are set to satisfy the following relation:

$$L3\leqq L2.$$

5. The color image forming means of claim 1, further comprising:

transfer means for transferring the color image onto a recording sheet; and pre-transfer exposure means for uniformly exposing a portion of the peripheral surface at a pre-transfer exposing position before the color image is transferred;

wherein the transfer means has a casing and the imagewise exposure means and the transfer means are arranged such that the portion on the peripheral surface located at the pre-transfer exposing position moves into the casing of the transfer means before the electric potential of the portion on the peripheral surface at the pre-transfer exposing position is lowered to half of V2 (V2/2), where V2 is the electric potential on the peripheral surface located at the pre-transfer exposing position.

6. The color image forming means of claim 1, wherein:

the distance on the peripheral surface between the pre-transfer exposing position by the pre-transfer exposure means and the transfer position by the transfer means is L21, the distance on the peripheral surface between the pre-transfer exposing position by the pre-transfer exposure means and an edge of the housing of the transfer means at the pre-transfer exposure means-side is L22, and

L21 and L22 are set to satisfy the following relation:

$$L22<(1/2)\times L21.$$

7. The color image forming means of claim 1, further comprising:

cleaning means for cleaning residual toner on the image forming member; and pre-cleaning exposure means for uniformly exposing a portion of the peripheral surface at a pre-cleaning exposing position before the residual toner is cleaned;

wherein the cleaning means has a casing and the pre-cleaning exposure means and the cleaning means are arranged such that the portion on the peripheral surface at the pre-cleaning exposing position moves into the casing of the cleaning means before the electric potential of the portion on the peripheral surface at the pre-cleaning exposure means is lowered to half of V3 (V3/2), where V3 is the electric potential on the peripheral surface located at the pre-cleaning exposing position.

8. The color image forming means of claim 7, wherein an electric bias having the same polarity as that of toner is applied to an edge of the casing of the cleaning means at a pre-cleaning exposure means-side.

9. The color image forming means of claim 7, wherein:

the cleaning means has a cleaning blade, the distance on the peripheral surface between the pre-cleaning exposing position by the pre-cleaning exposure means and a contact position of the cleaning blade on the image forming member is L31, the distance on the peripheral surface between the pre-cleaning exposing position by the pre-cleaning exposure means and an edge of the housing of the cleaning means at the pre-cleaning exposure means-side is L32, and

L31 and L32 are set to satisfy the following relation:

$$L32<(1/2)\times L31.$$

* * * * *